US005230357A

United States Patent [19]

Sisson

[11] Patent Number: 5,230,357

[45] Date of Patent: Jul. 27, 1993

[54] MULTIPLE FUNCTION DISH, GLASS AND SILVERWARE CART

[76] Inventor: Donald A. Sisson, 12845 Clermont, Thornton, Colo. 80241

[21] Appl. No.: 773,138

[22] Filed: Oct. 8, 1991

[51] Int. Cl.[5] ..... B08B 3/04

[52] U.S. Cl. ..... 134/85; 134/115 R; 134/104.2; 134/201; 312/228

[58] Field of Search ..... 134/59, 61, 66, 85, 134/92, 104.2, 115 R, 133, 201; 210/176, 376; 312/228

[56] References Cited

U.S. PATENT DOCUMENTS

| | | | |
|---|---|---|---|
| 395,393 | 1/1889 | Holzmark | 312/228 X |
| 947,115 | 1/1910 | Mercer | 312/228 X |
| 1,256,926 | 2/1918 | Psiaki | 134/85 X |
| 1,769,165 | 7/1930 | Rhoades et al. | 134/92 |
| 2,022,591 | 11/1935 | Everitt | 312/228 X |
| 2,502,265 | 3/1950 | Macon | 312/228 X |
| 3,157,904 | 11/1964 | Flodell | 134/115 X |
| 3,445,150 | 5/1969 | Zartarian . | |
| 3,511,252 | 5/1970 | Kennedy | 134/199 |
| 3,544,183 | 12/1970 | Dixon . | |
| 4,527,707 | 7/1985 | Heymann et al. . | |

*Primary Examiner*—Frankie L. Stinson
*Attorney, Agent, or Firm*—James R. Young

[57] ABSTRACT

Disclosed are three buss carts designed for holding glassware, silverware, and dishes removed from tables in a bussing process. Also disclosed is a combination cart that allows a table to be cleared by one person. A glassware cart includes a basin, which drains into a holding tank, for dumping liquid from glassware before the glassware is placed in tubs stored on the cart. A silverware cart includes separate trays, each containing a presoak solution, for each type of silverware. A dish cart includes a plurality of trays for holding a large number of dishes, and has a central chute to allow food leftovers to be directed into a scrap trap. A liquid holding tank below the scrap trap catches any liquid from the dishes, and allows the dishes to be pre-rinsed before they are removed from the cart. The combination cart includes the features from the other carts.

5 Claims, 8 Drawing Sheets

MULTIPLE FUNCTION DISH, GLASS AND SILVERWARE CART

FIELD OF THE INVENTION

This invention relates to kitchen equipment and more particularly to restaurant kitchen equipment. Even more particularly, the invention relates to equipment for rapidly removing the dishes, glasses and silverware from a large number of tables such as at a banquet.

BACKGROUND OF THE INVENTION

In most restaurants today, bussing of tables is performed by removing the dishes, glassware, and silverware from the table, placing these in a plastic tub along with the leftover food soil and liquids. The tub is then taken to the dishroom, and the person washing dishes then sorts the dishware, glassware, silverware, scrapes the soil from these items, pre-rinses the items, and places them into the dish machine for washing.

Often, however, food soil is left on the items and they are simply placed into the dish machine. This happens because the person operating the dish machine is overloaded, giving them no time for proper scraping and sorting. This results in the water in the dish tank being extremely dirty, breakage occurs, and the dishes, glasses and silverware contain soil when they leave the dish machine.

The problem is more severe in banquet operations where several hundred tables may be cleared. The glasses are often placed in glass racks with liquids remaining in the glasses. The dishes and silverware sit in buss tubs for several hours, causing the soil to harden, before being washed in the dish machine.

It is thus apparent that there is a need in the art for an improved method and apparatus which allows dishes, glasses and silverware to be prepared for the dish machine when tables are bussed. There is another need for an apparatus and system that allows liquids to be removed from glasses at the time a table is bussed. There is a further need for such an apparatus and system that allows silverware to be placed in a presoak solution to prevent soil from hardening on the silverware before it is placed in the dish machine. Yet another need is for an apparatus that collects food soil from dishes and allows the dishes to be easily pre-rinsed. A still further need is for a system an apparatus that provides a combination apparatus or cart to perform these functions. The present invention meets these and other needs.

SUMMARY OF THE INVENTION

It is an aspect of the invention to provide an apparatus and method for improved bussing of tables in a restaurant.

It is another aspect to provide a buss cart having a liquid storage compartment that allows liquid to be removed from glassware before the glassware is placed in a washing tub located on the cart.

Yet another aspect is to provide a buss cart having a plurality of trays containing presoak solution for storing silverware before the silverware is placed into the dish machine.

Still another aspect is to provide a buss cart having dish storage racks with a central chute for disposing of leftover food when the dishes are placed into the cart and pre-rinsed.

A further aspect of the invention is to combine the above three buss carts into a single cart having the characteristics of all three carts.

The above and other aspects of the invention are included in three buss carts designed for removing glassware, silverware, and dishes from tables in a process involving two separate buss teams. The invention also includes a combination cart that allows a single buss-person to completely clear a table.

The glassware buss cart includes a basin for dumping liquid from the glassware before the glassware is placed on the cart. The basin drains into a holding tank which is later drained into a floor drain. The cart includes a glassware washing tub holding area which will allow several glassware washing tubs to be placed on top of each other to allow the cart to hold a large number of glasses, thus facilitating bussing of a large number of tables, such as at a banquet The silverware cart includes separate trays for each type of silverware being removed from a table, thus the silverware can be separated at the time it is bussed. The trays contain a presoak solution, so that the silverware can remain on the cart for long periods before being washed without causing the food soil to harden. The cart also includes a system for draining the presoak into a floor drain.

The dish cart includes a plurality of shelves for holding a large number of dishes, and has a central chute to allow food leftovers to be directed from the dishes on the shelves into a scrap trap. A liquid holding tank below the scrap trap catches any liquid remaining on the dishes, and also allows the dishes to be pre-rinsed before they are removed from the cart.

The combination cart includes features from all three of the above-described carts, and can be used by a single person to completely buss a table.

BRIEF DESCRIPTION OF THE DRAWINGS

The above and other aspects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
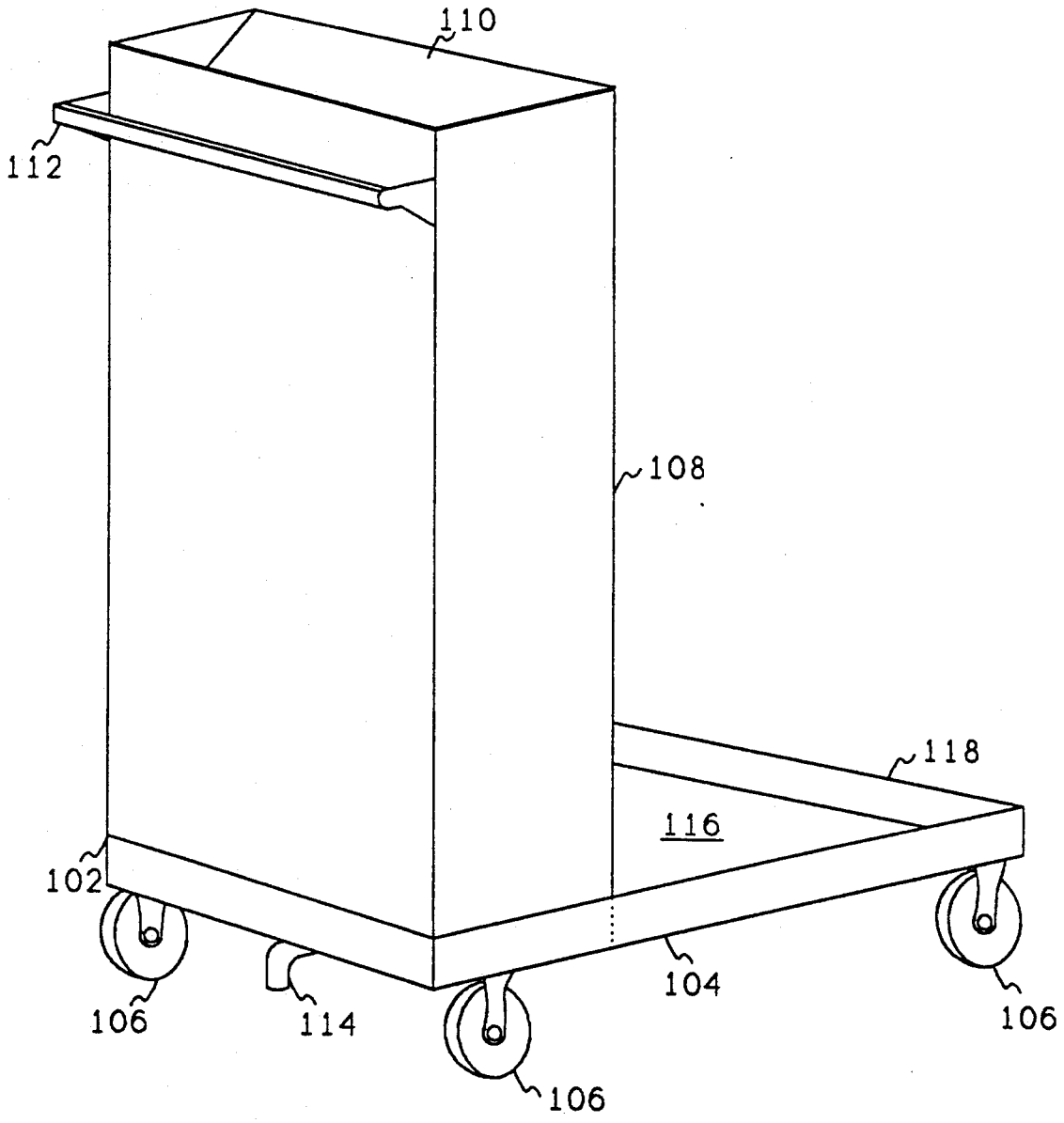
FIG. 1 shows a perspective view of a buss cart for storing liquid removed from glasses and for storing glass washing tubs.

FIG. 1 shows a perspective view of a buss cart for storing liquid removed from glasses, and for storing glass washing tubs used to hold the glasses after the liquid is removed. Referring now to FIG. 1, a buss cart 102 contains a base 104 which is supported by a plurality of wheels or casters 106. A holding tank 108 is attached to one end of the base 104. A dump basin 110 is located at the top of the holding tank 108, and a drain 114 is located at the bottom of the holding tank 108. Liquid dumped into the basin 110 flows directly into the holding tank 108 where it is stored. Later it is drained into a floor drain through the drain 114. A handle 112 is attached to a side of the holding tank 108 to allow the person to easily push the cart 102 from the kitchen to the dining area and back.

A tub holding area 116 is surrounded on three sides by a rail 118 attached to the base 104. The fourth side of the tub holding area is formed by the holding tank 108.

When a table is to be bussed, the buss cart 102 is rolled from the kitchen to the table. The glasses are then removed from the table and liquid dumped into the holding tank 108 through the basin 110. After dumping the liquid from the glasses into the holding tank 108, the glasses are then placed in a glass washing tub (not shown), which is placed on the tub holding area 116. The holding tank 108 is of sufficient height to allow a person to conveniently remain standing while accessing the handle 112. Therefore, the holding basin 108 will hold several gallons of liquid. Furthermore, because of the height of the holding tank 108, a large number of glass washing tubs may be placed on the tub holding area 116. Therefore, the buss cart 102 may be used to remove glasses from a very large number of tables before the cart must be returned to the kitchen in order to unload the glasses that have been removed from the tables and drain the holding tank. In this manner, the buss cart 102 may be used to buss the glasses from tables from a large banquet at one time.

Figure 2:
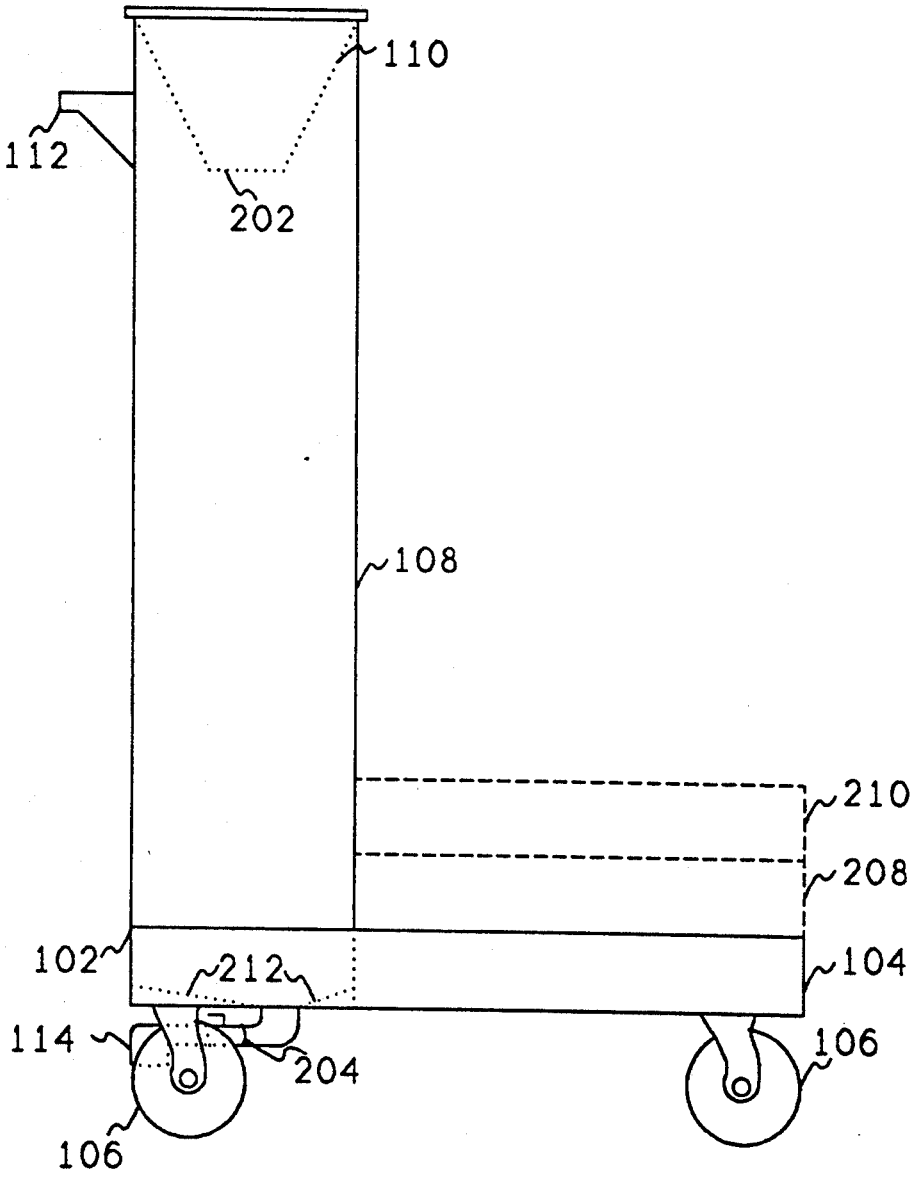
FIG. 2 shows a side view of the cart of FIG. 1.

FIG. 2 shows a side view of the cart of FIG. 1. Referring now to FIG. 2, the basin 110 is shown having a perforated bottom 202 which allows liquid to drain from the basin 110 into the holding tank 108. The bottom of the holding tank 108 extends to the floor of the base 104. The base of the holding tank 108 contains angled base pieces 212, which allows the liquid contained in the holding tank 108 to easily flow into the drain 114. The drain 114 contains a valve 204 to allow the holding tank 108 to be easily dumped into a floor drain. Glass washing tubs 208 and 210 are shown placed on the tub holding area. As illustrated, a plurality of glass washing tubs may be placed on the holding area stacked one on top of another.

Figure 3:
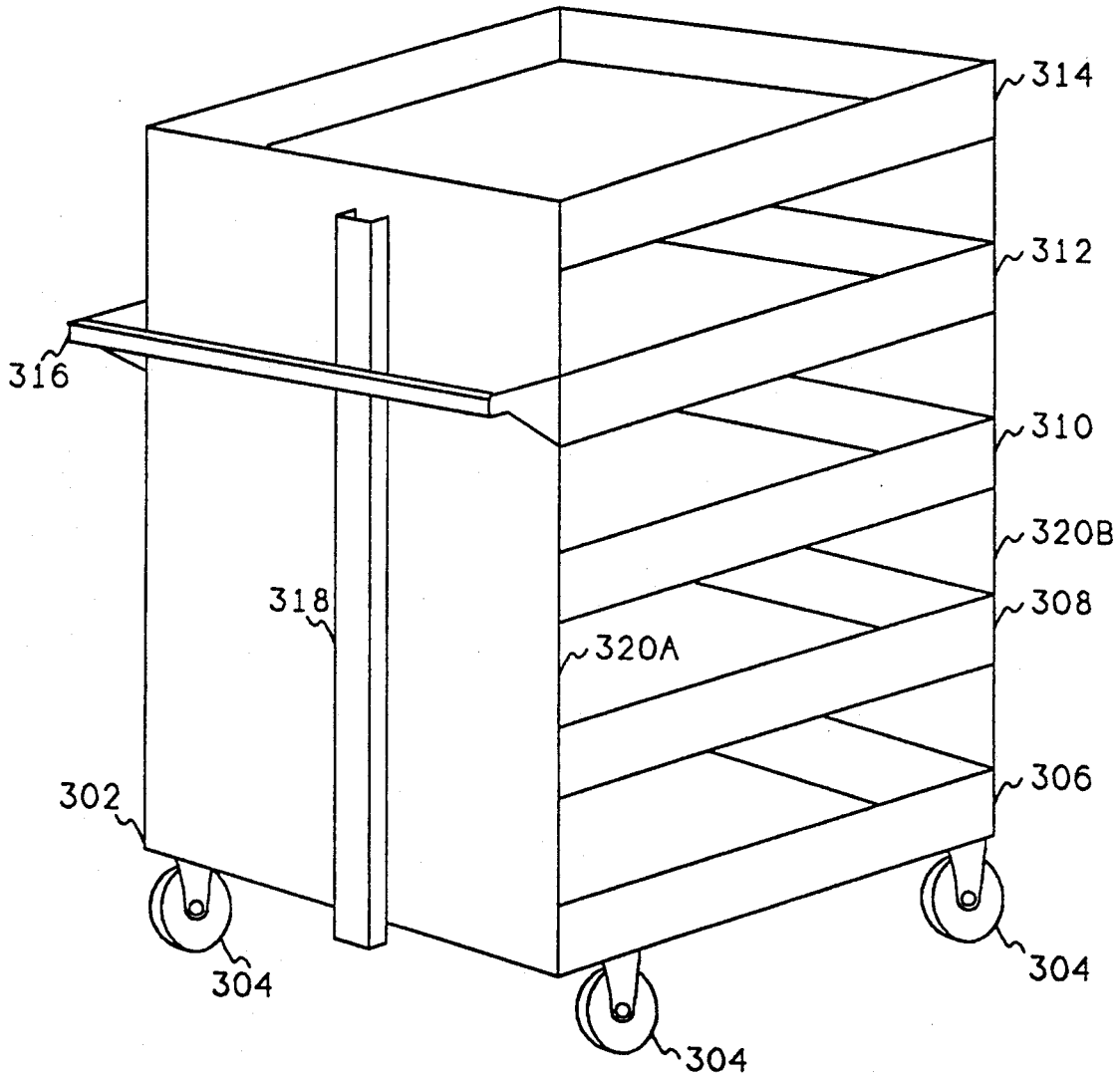
FIG. 3 shows a perspective view of a buss cart for storing silverware in a presoak solution.

FIG. 3 shows a perspective view of a buss cart for storing silverware in a presoak solution Referring now to FIG. 3, a buss cart 302 is supported by several wheels or casters 304. A handle 316 is used to move the cart from one location to another. The cart 302 contains a plurality of trays 306, 308, 310, 312, and 314 held together by support pieces 320A and 320B. Each of these trays has a connection (not shown in FIG. 3) to a central drain 318. A presoak solution, that is water or a chemical used to presoak silverware prior to its being washed, is placed in each of the trays 306–314. As silverware is removed from a table, it is separated and the various pieces are placed in each of the trays. Thus, for example, knives might be placed in tray 306, salad forks in tray 308, other forks in tray 310, spoons in tray 312, and any other silverware on the table in tray 314. Alternatively, tray 314 may be left empty of presoak solution to allow condiments to be stored on the tray. Because the silverware rests in a presoak solution, the silverware may sit for a long period of time prior to being placed in the dish machine.

Figure 4:
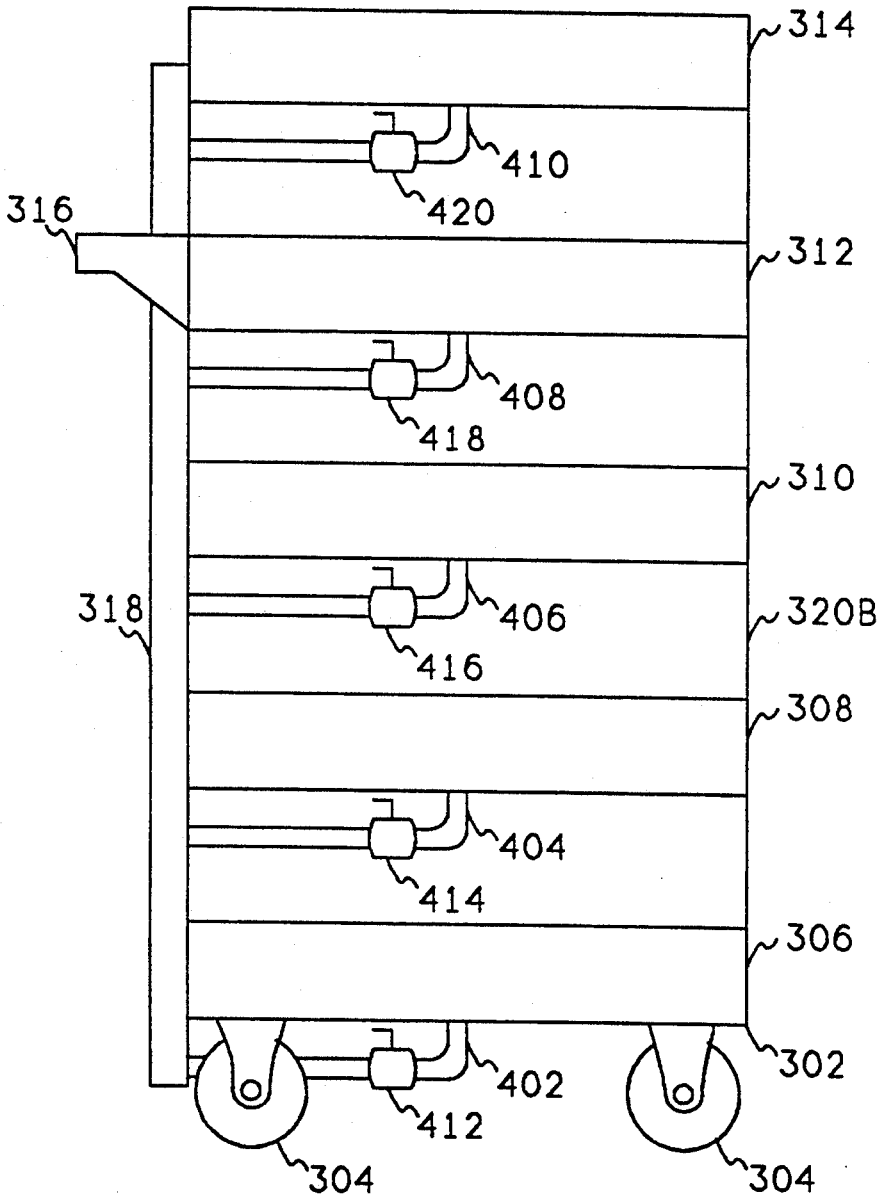
FIG. 4 shows a side view of the cart of FIG. 3.

FIG. 4 shows a side view of the buss cart of FIG. 3. Referring now to FIG. 4, the cart 302, supported by wheels 304, and containing trays 306, 308, 310, 312, and 314 is shown. Each of the trays 306–314, contains a drain 402–410, respectively. Each of the drains 402–410 contains a valve 412–420 respectively. The liquid flows through the drains 402–410 into the common drain pipe 318 and into a floor drain when the valves 412–420 are turned to allow the presoak solution to be drained.

Figure 5:
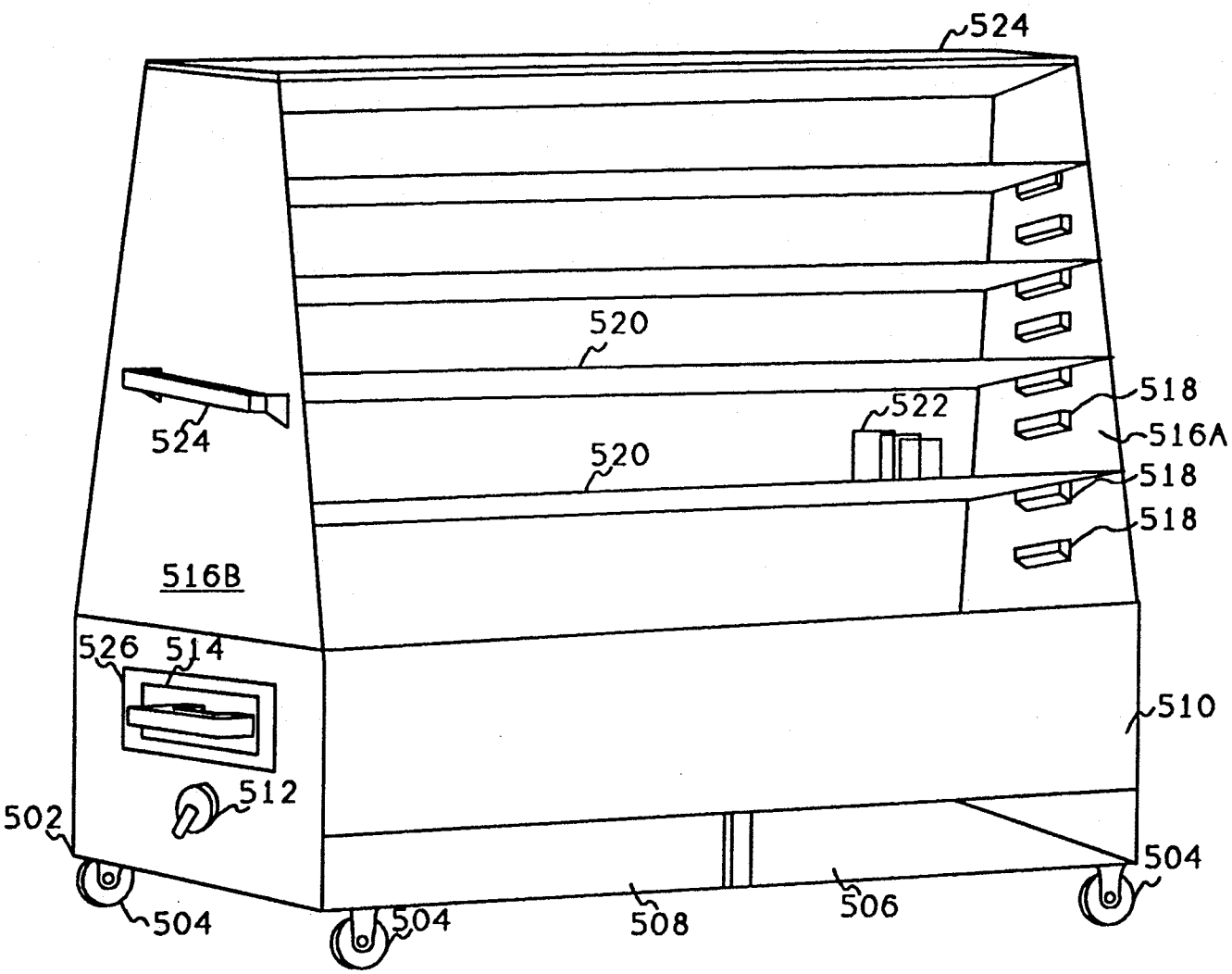
FIG. 5 shows a perspective view of a buss cart for storing dishes, wherein the dish cart contains a central chute for moving leftover food to a scrap tray.

FIG. 5 shows a perspective view of a buss cart for storing dishes. Referring now to FIG. 5, a dish cart 502 is shown having wheels or casters 504 and a handle 524 which allows the cart to be moved from one location to another. The base of the cart 502 contains two large storage areas 506 and 508 which may be used to store plastic trays or tubs. A liquid holding tank 510 is located at the bottom of the buss cart 502. A drain 512 is used to drain liquid from the holding tank 510 into a floor drain. At the top of the liquid holding tank 510 is a scrap trap 514, which will be better illustrated below. End frame pieces 516A and 516B contain shelf supports 518. Shelves 520 are placed on the shelf supports 518 to hold dishes standing on end. The dishes are placed onto the shelves 520 on an edge between wire frames, such as the example wire frames 522. The shelves 520 are tilted toward the center of the cart 502, as will be better illustrated below, to allow food scraps to fall from the plates into a central chute and down into the scrap trap 514. Also, after the dish cart 502 is completely loaded with dishes, the dishes may be pre-rinsed while they are located on the cart. Any liquid that was originally on the dishes, and the pre-rinse liquid, falls into the holding tank 510 to be drained through the drain 512. A top 524 of the dish cart 502 is designed to be of a size to contain plastic tubs which are used for holding dishes and other items when a table is bussed.

Figure 6:
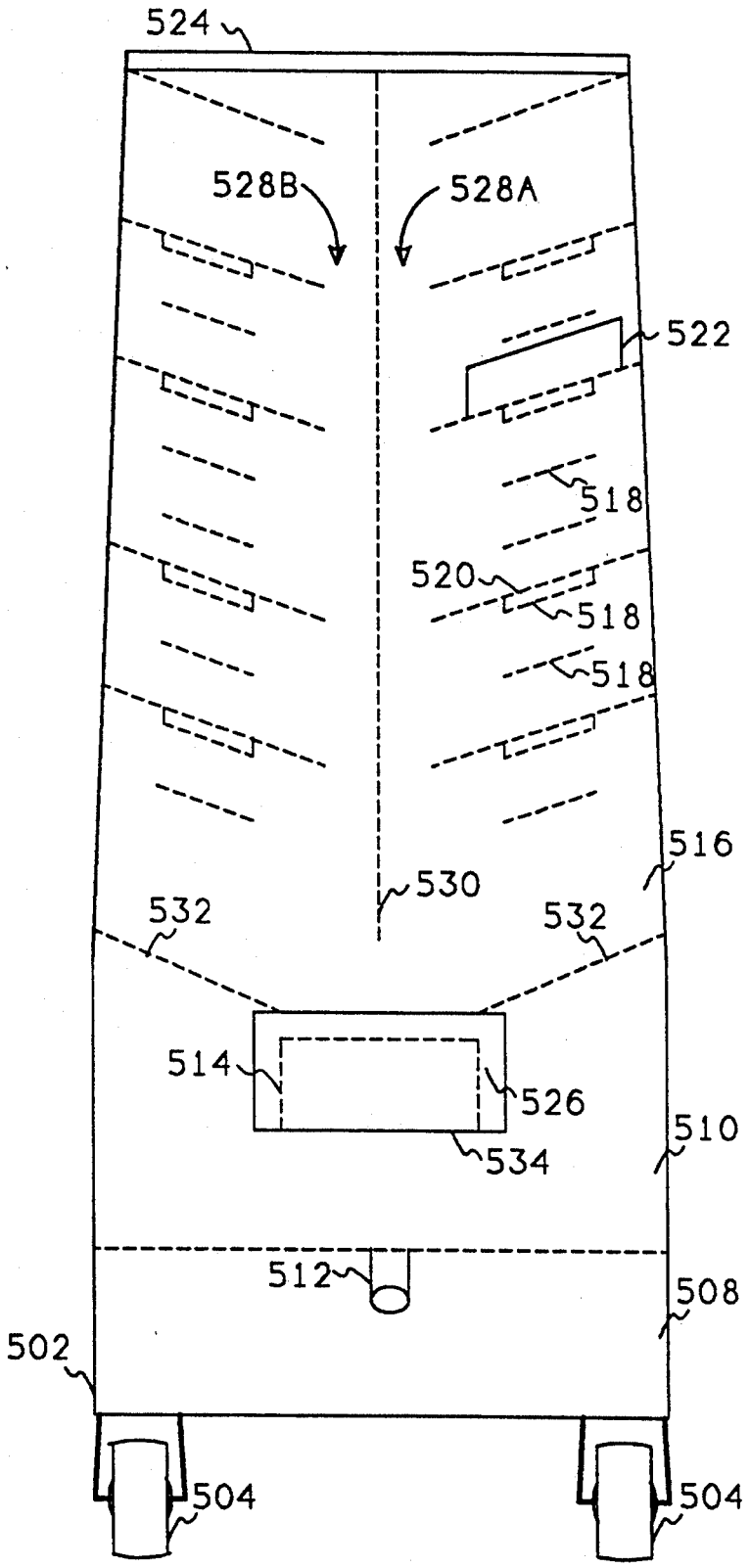
FIG. 6 shows an end view of the cart of FIG. 5.

FIG. 6 shows an end view of the buss cart of FIG. 5. Referring now to FIG. 6, the buss cart 502 is shown with the wheels or casters 504. The plurality of shelf supports 518 allows shelves 520 to be placed at varying distances apart. FIG. 6 better illustrates that the shelves 520 are placed at an angle which allows food scraps to fall from the plates as the plates are placed into the shelves and down through the chutes 528A and 528B into the scrap trap 514. A center partition 530 separates the shelves on either side of the dish cart so that food scrap falls down into the food trap rather than going through the dish cart to the dishes on the other side. The partition 530 ends some distance above the scrap trap 514 to prevent food from getting caught between the partition 530 and the base shelves 532 of the dish cart. The bottom 534 of the scrap trap 514 is perforated to allow liquid to drain through the scrap trap into the holding tank 510. This feature allows the dishes to be pre-rinsed while they remain in the cart 502 allowing water from the pre-rinse to drain through the scrap trap into the holding tank 510. A flange 526 is shown on the end of the scrap trap 514 to prevent food and liquid from spilling out of the cart 502 around the edges of the scrap trap 514. A valve (not shown) within the drain 512 keeps the liquid in the holding tank 510 until the dish cart is moved over a floor drain at which time the valve is opened to drain the liquid from the holding tank 510 through the drain 512 and into the floor drain (not shown).

The above-described three carts can be easily used in a wave method bussing system for clearing a large number of tables at a banquet. Using the wave method, the buss-workers are divided into two teams or groups. The first group pulls chairs from the tables and stacks them out of the way. The second group then follows with the glassware cart 102. Using this cart, the second group removes all glassware, cups, etc., and dumps the liquid into the basin 110 before placing the glassware into the top glassware tub 210. Removing the glassware first helps prevent breakage and placing the glassware into the dish machine first achieves better cleaning results.

The first group, now finished stacking the chairs, follows the second group with the silverware cart 302. The first group removes and separates the silverware, placing it into the separate trays of the silverware cart 302. This group also removes condiments and bread baskets and places them into the top shelf 314 of the silverware cart. In this method, the top shelf does not contain presoak solution.

The second group now follows with the dish cart 502, removing the heavy soil into buss tubs which are placed into the tub holding areas 506 and 508. The dishes are then placed in the shelves 518 where the remaining soil falls through the chute into the scrap trap. After the dishes are cleared, the first group returns to remove the linen from the tables while the second group pre-rinses the dishes in the dish cart before placing them into the dish machine.

Figure 7:
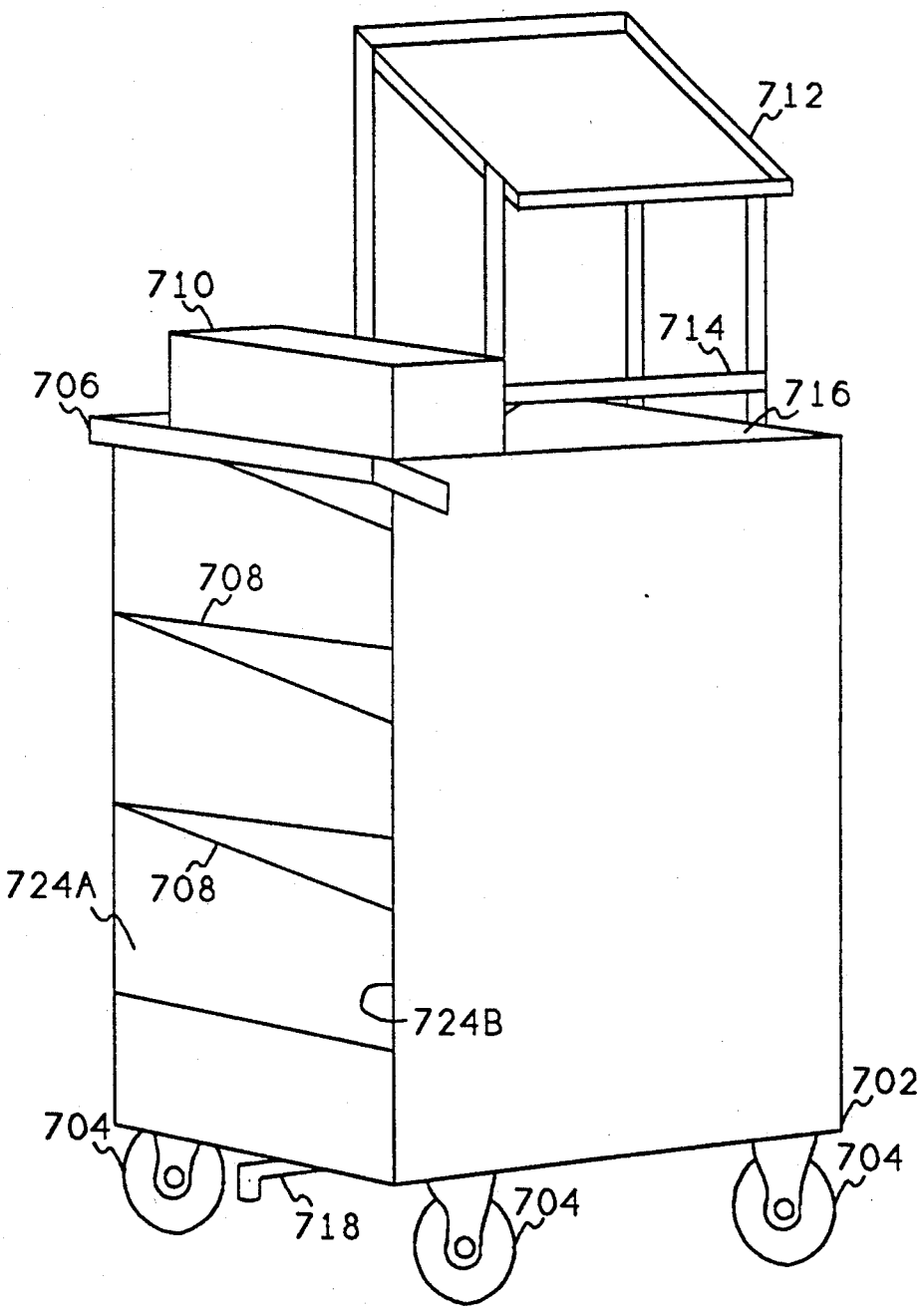
FIG. 7 shows perspective view of a combined buss cart for storing dishes, glasses, and silverware.
Figure 8:
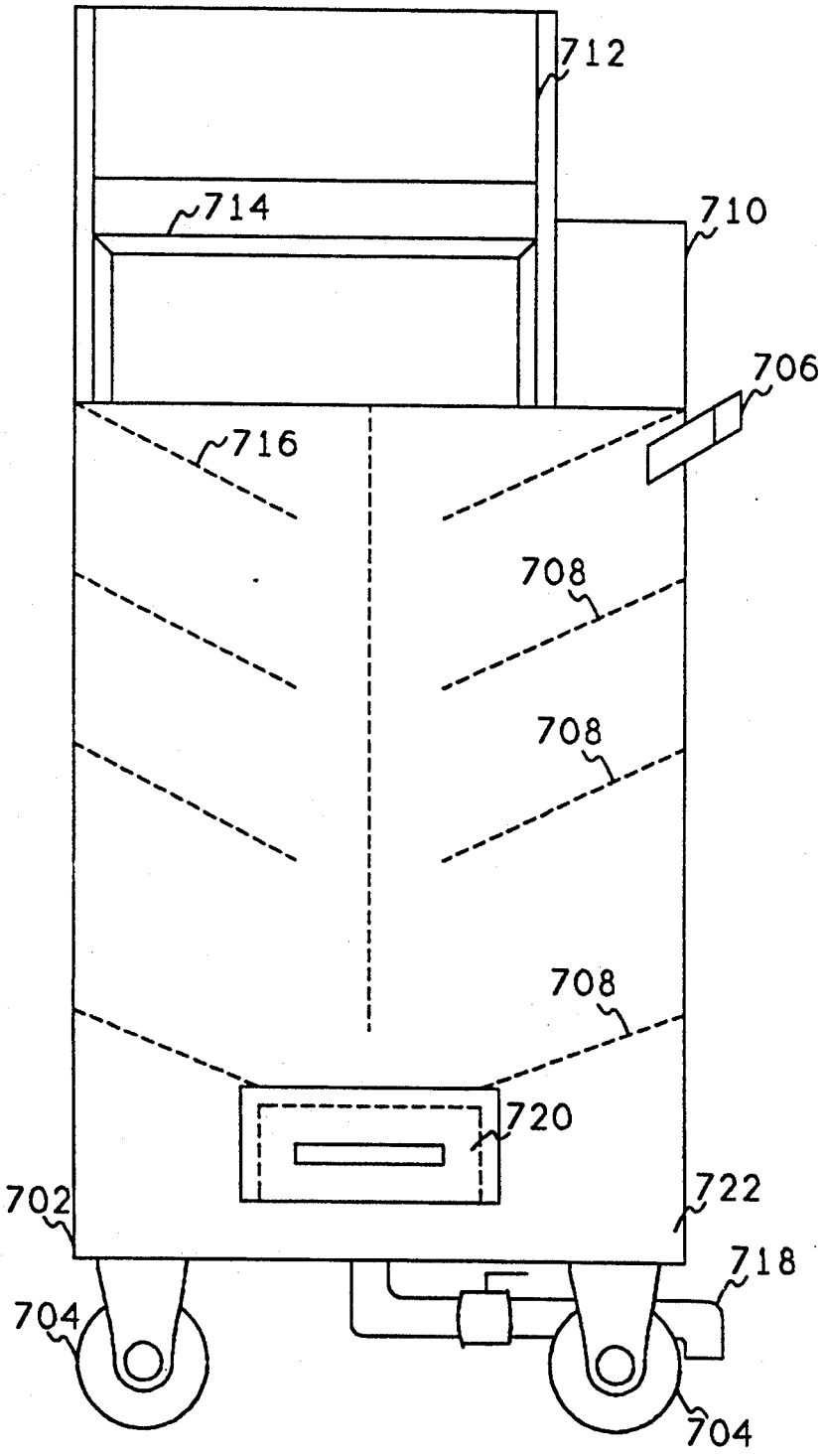
FIG. 8 shows a side view of the cart of FIG. 7.

FIGS. 7 and 8 show a perspective view, and end view, respectively, of a combination buss cart for storing dishes, silverware, and glassware. Referring now to FIGS. 7 and 8, a cart 702 is shown having wheels or casters 704 and a handle 706 which allows the cart to be moved from one location to another. A liquid holding tank 722 is arranged at the bottom of the cart 702. A drain 715 is used to drain liquid from the holding tank 722 into a floor drain. At the top of the liquid holding tank 722 is a scrap trap 720 which functions in the same manner as the scrap trap 514 of FIG. 6. End frame pieces 724A and 724B contain shelf supports for shelves 708, which hold dishes standing on end. The dishes are placed onto the shelves 708 on an edge between wire frames (not shown). The shelves 708 are tilted toward the center of the cart 702 to allow food scraps to fall from the plates into a central shoot and down into the scrap trap 720. Also, after the dish cart 702 is completely loaded with dishes, the dishes may be pre-rinsed while they are located on the cart. Any liquid that was originally on the dishes, and the pre-rinse liquid, falls into the holding tank 722 to be drained through the drain 718.

The cart 702 also contains a pair of glassware washtub holders 712 and 714 which are oriented to allow glassware to be loaded from either side of the cart. Before loading the glassware into the holders 712 and 714, liquid is dumped into a basin 716, and the liquid then drains into the holding tank 722.

The cart 702 also contains a silverware tray 710 which contains a presoak liquid. Although not illustrated in FIGS. 7 and 8, the presoak liquid from the silverware tray 710 can be drained into the holding tank 722 for later disposal through drain 718.

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A combination cart for storing dishes, silverware, and glassware during a process of clearing tables, said combination cart comprising:
   - a base;
   - a pair of side pieces connected to said base;
   - at least one shelf mounted between said side pieces, whereby said dishes are placed on said shelf;
   - a chute located at an inside end of said at least one shelf;
   - a tray mounted to at least one of said pair of side pieces, said tray being located at a bottom of said chute, said tray further having a perforated bottom;
   - a holding tank for storing liquid from said dishes, said holding tank being mounted below said tray on said base;
   - a glassware washtub storage area connected to a top of said side pieces;
   - a basin for receiving liquid from glassware, said basin being connected to drain into said holding tank;
   - a silverware tray mounted adjacent said glassware washtub storage area; and
   - means for draining said holding tank;
   - whereby liquid and food scrap from said dishes, and liquid from said basin, flows through said chute into said tray and liquid drains through said tray into said holding tank.

2. The combination cart of claim 1 further comprising wheel means attached to said base to facilitate movement of said combination cart from one location to another.

3. The combination cart of claim 1 further comprising adjustable shelf mounting means for mounting said at least one shelf at a plurality of locations between said side pieces.

4. The combination cart of claim 1 further comprising at least one shelf mounted to opposite ends of said cart wherein said chute is located between said shelves.

5. The combination cart of claim 4 further comprising divider means located within said chute between said shelves.

* * * * *